US008913941B2

(12) United States Patent
Shimada et al.

(10) Patent No.: US 8,913,941 B2
(45) Date of Patent: Dec. 16, 2014

(54) GLOSS APPLICATOR AND IMAGE FORMING APPARATUS INCLUDING SAME

(71) Applicants: Hiroyuki Shimada, Kanagawa (JP); Akiyasu Amita, Kanagawa (JP)

(72) Inventors: Hiroyuki Shimada, Kanagawa (JP); Akiyasu Amita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 40 days.

(21) Appl. No.: 13/707,167

(22) Filed: Dec. 6, 2012

(65) Prior Publication Data

US 2013/0170882 A1 Jul. 4, 2013

(30) Foreign Application Priority Data

Dec. 28, 2011 (JP) ..... 2011-289776

(51) Int. Cl.
*G03G 15/20* (2006.01)
*G03G 8/00* (2006.01)
*G03G 15/00* (2006.01)

(52) U.S. Cl.
CPC ..... *G03G 8/00* (2013.01); *G03G 2215/00805* (2013.01); *G03G 2215/2016* (2013.01); *G03G 15/6585* (2013.01); *G03G 15/6573* (2013.01)
USPC ..... 399/341; 399/122

(58) Field of Classification Search
None
See application file for complete search history.

(56) References Cited

U.S. PATENT DOCUMENTS 5,099,288 A * 3/1992 Britto et al. ..... 399/320
2002/0037176 A1* 3/2002 Ogino et al. ..... 399/68
2003/0165348 A1 9/2003 Amita et al.
2004/0091294 A1* 5/2004 Tani et al. ..... 399/324
2004/0245241 A1 12/2004 Kishi et al.
2004/0247332 A1 12/2004 Kishi et al.
2004/0247334 A1 12/2004 Kishi et al.
2004/0258426 A1 12/2004 Kishi et al.
2005/0139584 A1 6/2005 Kishi et al.
2005/0175368 A1 8/2005 Matsusaka et al.

(Continued)

FOREIGN PATENT DOCUMENTS

JP 2004-325934 11/2004
JP 2009-014876 1/2009
JP 2011-085873 4/2011

OTHER PUBLICATIONS

U.S. Appl. No. 13/480,555, filed May 25, 2012, Hiroyuki Kunii, et al.

(Continued)

*Primary Examiner* — Clayton E Laballe
*Assistant Examiner* — Ruifeng Pu
(74) *Attorney, Agent, or Firm* — Harness, Dickey & Pierce, P.L.C.

(57) ABSTRACT

A gloss applicator to apply a gloss to toner by heating and then forcibly cooling a toner image on a recording medium, includes: a plurality of rollers including a heat roller disposed upstream in a conveyance direction of the recording medium bearing the toner image thereon; an endless belt wound around the plurality of rollers and including a taut portion along the conveyance direction of the recording medium; a pressure roller disposed at a position opposite the heat roller sandwiching the endless belt together with the heat roller; a cooling member disposed at an interior surface of the taut portion of the endless belt; and a pair of separating members disposed at both ends of the cooling member and configured to contact and separate the endless belt to and from the cooling member so as to change an area of contact of the cooling member with the endless belt.

10 Claims, 3 Drawing Sheets

(56) References Cited

U.S. PATENT DOCUMENTS

| | | | | |
|---|---|---|---|---|
| 2005/0175370 | A1 | 8/2005 | Matsusaka et al. | |
| 2005/0191078 | A1 | 9/2005 | Kishi et al. | |
| 2005/0244181 | A1* | 11/2005 | Bobo et al. | 399/67 |
| 2006/0029411 | A1 | 2/2006 | Ishii et al. | |
| 2006/0039713 | A1 | 2/2006 | Kishi et al. | |
| 2006/0051111 | A1 | 3/2006 | Kishi et al. | |
| 2006/0051112 | A1 | 3/2006 | Matsusaka et al. | |
| 2006/0051113 | A1 | 3/2006 | Kishi et al. | |
| 2006/0051119 | A1 | 3/2006 | Kishi et al. | |
| 2006/0051120 | A1 | 3/2006 | Kishi et al. | |
| 2006/0051121 | A1 | 3/2006 | Matsusaka et al. | |
| 2006/0127118 | A1 | 6/2006 | Kishi et al. | |
| 2006/0165443 | A1 | 7/2006 | Yoshinaga et al. | |
| 2006/0177232 | A1 | 8/2006 | Ehara et al. | |
| 2006/0182460 | A1 | 8/2006 | Kishi et al. | |
| 2006/0257183 | A1 | 11/2006 | Ehara et al. | |
| 2007/0014600 | A1 | 1/2007 | Ishii et al. | |
| 2007/0031159 | A1 | 2/2007 | Kishi et al. | |
| 2007/0036573 | A1 | 2/2007 | Kishi et al. | |
| 2007/0212090 | A1 | 9/2007 | Matsusaka et al. | |
| 2008/0145088 | A1 | 6/2008 | Matsusaka et al. | |
| 2009/0123172 | A1 | 5/2009 | Kishi et al. | |
| 2009/0274477 | A1 | 11/2009 | Okamoto et al. | |
| 2009/0274494 | A1 | 11/2009 | Okamoto et al. | |
| 2009/0274495 | A1 | 11/2009 | Okamoto et al. | |
| 2009/0274496 | A1 | 11/2009 | Okamoto et al. | |
| 2009/0274497 | A1 | 11/2009 | Okamoto et al. | |
| 2009/0274498 | A1 | 11/2009 | Okamoto et al. | |
| 2009/0317113 | A1 | 12/2009 | Kishi et al. | |
| 2011/0030927 | A1* | 2/2011 | Okano et al. | 165/104.33 |
| 2011/0064494 | A1 | 3/2011 | Amita et al. | |
| 2011/0085815 | A1 | 4/2011 | Kishi et al. | |
| 2011/0176822 | A1 | 7/2011 | Ishii et al. | |
| 2011/0188911 | A1 | 8/2011 | Kunii et al. | |
| 2012/0008153 | A1 | 1/2012 | Kunii et al. | |
| 2012/0093547 | A1* | 4/2012 | Baba et al. | 399/329 |
| 2012/0201579 | A1 | 8/2012 | Kunii et al. | |
| 2012/0224898 | A1 | 9/2012 | Amita et al. | |

OTHER PUBLICATIONS

U.S. Appl. No. 13/454,671, filed Apr. 24, 2012, Hiroyuki Kunii, et al.
U.S. Appl. No. 13/537,912, filed Jun. 29, 2012, Satoshi Muramatsu, et al.
U.S. Appl. No. 13/471,878, filed May 15, 2012, Hiroyuki Kunii, et al.
U.S. Appl. No. 13/528,015, filed Jun. 20, 2012, Akiyasu Amita, et al.

* cited by examiner

GLOSS APPLICATOR AND IMAGE FORMING APPARATUS INCLUDING SAME

CROSS-REFERENCE TO RELATED APPLICATION

The present application claims priority from Japanese patent application number 2011-289776, filed on Dec. 28, 2011, the entire disclosure of which is incorporated by reference herein.

BACKGROUND OF THE INVENTION

1. Field of the Invention

The present invention relates to a gloss applicator and an image forming apparatus, and more specifically relates to printed output gloss control.

2. Description of the Related Art

As is known, in an image forming apparatus employing an electrophotographic method, an electrostatic latent image formed on a photoreceptor or a latent image carrier is rendered visible by toner, after which the visible toner image is transferred onto a recording medium such as a recording sheet and fixed thereon, thereby obtaining printed output.

Images obtained as printed output include not only monochrome images but also multi-color images such as full-color images. Concerning the appearance and color-reproducibility of the image, glossiness of the image and that of the recording medium bearing the image thereon are very important. In particular, matching of the glossiness of the two is necessary to make the image appear natural, as disclosed in JP-2004-32593-A.

As a factor defining the glossiness, there is melting/permeating property of the toner with respect to the recording medium. As a device exploiting the melting/permeating property, a fixing device is used.

The typical fixing device may be configured to use a heat-roller fixing method, including a fixing roller with a built-in heat source such as a halogen lamp and a pressure roller in contact with the fixing roller in combination. In addition, there is another method called a belt-fixing method using a belt having a low thermal capacity.

As a known structure using the belt-fixing method, a fixing belt with an elastic surface formed of silicon rubber and a release layer formed of fluorine resins on the surface of the silicon rubber surface is stretched over a plurality of rollers; a pair of a stretched roller and a pressure roller is opposed to each other with the fixing belt in between; and a heat source such as a halogen lamp is built into the stretched roller.

In such a fixing device, when a recording sheet on which a toner image is formed is passed between the fixing belt and the pressure roller, color toner on the sheet is melted by heat and is fixed onto the recording sheet or medium. Because a fixing nip can arbitrarily be set due to its belt structure in the fixing-belt method, there are advantages such as the ability to fix at a lower temperature (i.e., energy-saving effect) and improved separability of the recording medium from the belt. On the other hand, the recording medium bearing a toner image being a target of fixation thereon varies from a plain paper having a concave-convex surface with less glossiness to a highly glossy sheet such as art paper, coated paper, slightly coated paper, and the like, having a smooth surface and higher glossiness. The use of the glossy paper for fixation has come to be desired recently.

Of these paper materials, the art paper and the coated paper each have a glossier surface than the plain paper because a coating layer formed of resins, for example, is coated on the surface of such paper. Further, in recent years, a low-gloss sheet or matt coated paper as the plain paper has come to be used to make the paper document look elegant. As a result, the image forming apparatus is required to stably output a high-quality image that the user desires even in forming a toner image on such various types of paper.

Conventionally, there is known a structure to obtain a desired glossiness, in which a recording sheet which has passed through the fixing process after image transfer is again heated so that the toner image is softened, and a gloss applicator which can apply smoothness similar to the smooth surface of the sheet conveyance belt to the softened toner image surface and further cool the heated toner image surface to make it easier for the recording sheet to be separated from the sheet conveyance belt. (See, for example, JP-2004-32593-A, described above, and JP-2009-14876-A.)

When improving the image quality by a higher glossiness of the toner image, as disclosed in the above patent-related documents, it is known that the smoothness of the surface of the conveyance member or the belt contacting the toner image when softening the toner image surface exerts a good effect. On the other hand, the recording sheet on which the glossiness-improved toner image improved by assimilating the smooth surface of the conveyance member is carried is cooled so that the toner surface is solidified, adhesiveness of the toner is reduced, and the recording sheet can be separated easily from the conveyance member. The solidification in this case is expected not to cause any degradation of the smoothness of the toner image surface.

Because the operation to assimilate the smooth surface of the belt to the toner image surface is performed in a state in which the toner image surface is softened, after the belt surface smoothness is transferred to the toner image surface, the cooling needs to be forcibly performed to solidify the toner, reduce the adhesiveness between the belt and the toner, and improve releasability of the sheet from the belt.

In the disclosed documents, a structure in which the cooling member such as a heat pipe or a heatsink in addition to sending air by a cooling fan is constantly in contact with the belt, which has passed through the heater section for smoothing the toner image surface, is used. However, such a structure has the following drawbacks.

First, because the cooling member is constantly in contact with the belt, the temperature of the belt which has passed through the heater section decreases, and, when reaching the heater section again, the belt mostly has a heat less than the temperature necessary to smooth the surface of the toner image as desired. Then, the temperature-raising time for the heater section increases and the more power consumption is required to raise the temperature of the heater section.

Second, when the cooling member remains in contact with the belt, the cooling member prevents the belt from moving freely and slippage occurs between the belt and the rollers around which the belt is wound.

For example, in a case in which a heating nip is formed using the pressure roller and the heat roller disposed in the heating section, if the belt is separated from the heat roller to prevent excessive heating of the pressure roller, the belt receives friction resistance from the cooling member due to the contact with the cooling member, resulting in slippage between the belt and the drive roller and a loss of coupled operation with the heat roller. As a result, heating and thermal capacity applying time to the recording sheet becomes unstable and a desired glossiness cannot be obtained.

In addition, resistance of the cooling member to the movement of the belt causes abrasion of the interior surface of the belt, and when the abrasion increases, a thickness of the belt changes and uniform contact between the belt and the recording sheet is prevented. As a result, it becomes difficult to obtain a smoothness of the toner image surface smoothed by the smoothness of the belt surface. Thus, the desired glossiness depending on the smoothness of the belt would not be obtained.

SUMMARY OF THE INVENTION

The present invention provides an optimal gloss applicator to apply a gloss to toner by heating a toner image on a recording medium and by forcibly cooling it and includes: a plurality of rollers including at least a heat roller with a built-in heat source disposed upstream in a conveyance direction of the recording medium bearing the toner image thereon; an endless belt wound around the plurality of rollers and including a taut portion along the conveyance direction of the recording medium; a pressure roller disposed at a position opposite the heat roller sandwiching the endless belt together with the heat roller; a cooling member which can be contacted to or separated from the endless belt along the taut portion of the endless belt and disposed at an interior surface of the taut portion of the endless belt contacting the recording medium; and a pair of separating members disposed at both ends of the cooling member in the conveyance direction of the recording medium and configured to contact to or separate from an entire area of the taut portion of the endless belt from the cooling member so as to change an area of contact of the cooling member with the endless belt.

With such a structure, because the time required for raising the temperature of the endless belt can be shortened during the cooling member's non-contacting time, the consumed power can be reduced. In addition, because the cooling member is prevented from becoming a resistant member for the movement of the endless belt and an occurrence of the slippage is prevented, the abrasion of the endless belt can be prevented, thereby improving the durability of the belt.

These and other objects, features, and advantages of the present invention will become apparent upon consideration of the following description of the preferred embodiments of the present invention when taken in conjunction with the accompanying drawings.

DESCRIPTION OF THE PREFERRED EMBODIMENTS

Hereinafter, preferred embodiments of a gloss applicator will now be described with reference to the accompanying drawings.

Figure 1:
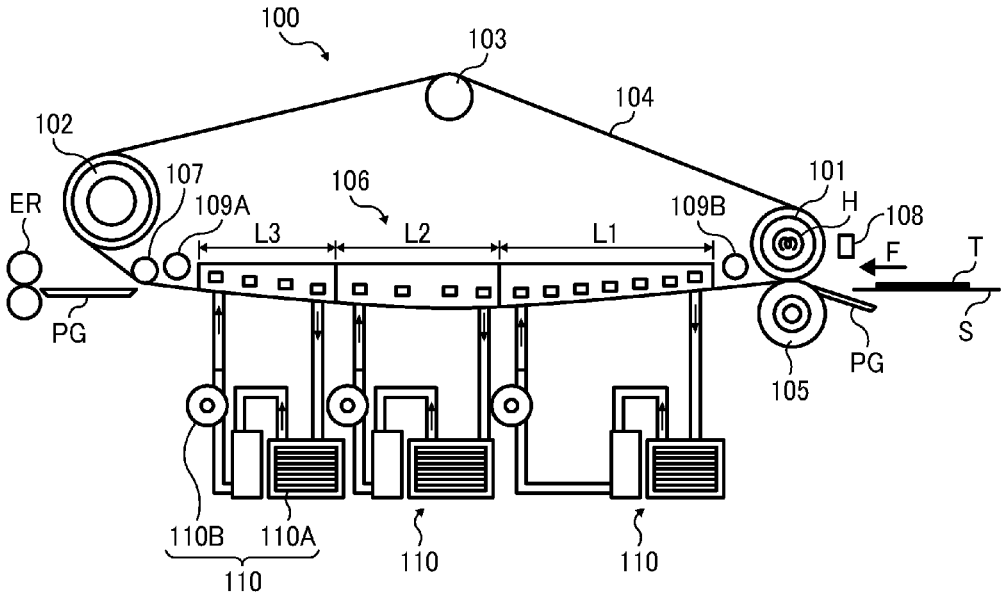
FIG. 1 is a schematic view of a gloss applicator according to an embodiment of the present invention.

FIG. 1 shows a schematic view illustrating a structure of a gloss applicator according to a first embodiment of the present invention.

As illustrated in FIG. 1, a gloss applicator 100 includes a heat roller 101; a drive roller 102; a tension roller 103; an endless belt 104; a pressure roller 105; and a cooling unit 106. The heat roller 101 functions as a heating member and is disposed upstream in a conveyance direction as indicated by an arrow F of a recording sheet S. The endless belt 104 is wound around the heat roller 101, the drive roller 102, and the tension roller 103, and is driven by the drive roller 102, of which a taut portion opposite the recording sheet S moves in the conveyance direction of the recording sheet S. The pressure roller 105 is disposed at a position opposite the heat roller 101 with the endless belt 104 disposed therebetween. The cooling unit 106 is disposed at an interior surface of the taut portion of the endless belt 104 opposite the recording sheet S.

As illustrated in FIG. 1, the gloss applicator 100 further includes a separation roller 107 to separate the recording sheet S using a bending stiffness of the recording sheet, a sheet discharge roller ER, and a guide member PG.

The endless belt 104 has a two-layered structure and is formed of a base member and a surface layer formed on an external surface of the base member. As a material for the base of the belt, a resin sheet with a high thermal resistance and a thickness of 10 to 300 μm can be used. Specifically, a polymer sheet formed of polyester, polyethylene, polyethylene-terephthalate, polyether sulfone, polyether ketone, polysulfone, polyimide, polyamide imide, polyamide, and the like, can be used.

The surface layer is formed of materials such as silicon resins or fluorine resins with a thickness of from 1 to 100 μm.

Because the endless belt 104 is a member to apply the gloss to the image, the surface of the surface layer is formed as a smooth surface appropriate to apply a high gloss. In this case, the smooth surface is configured to have an average roughness Ra of less than 0.3 μm and more preferably less than 0.1 μm.

In addition, the endless belt 104 is driven to rotate at a circumferential velocity of from 50 to 700 mm/sec by a driving force supplied by the driving roller 102.

The heat roller 101 is used to soften the surface of the toner carried on the recording sheet S and make the toner surface smooth similar to the smooth surface of the endless belt 104. The heat roller 101 is a cylindrical roller made of a metal such as aluminum and has an external diameter of ϕ50 to ϕ120 in mm.

The heat roller 101 includes a built-in halogen heater H and is heated by the halogen heater so that the surface of the heat roller 101 is set at a temperature less than the transition point of the toner into a glass. The temperature of the heat roller 101 is controlled to be within a range from 100 to 180 degrees C. by a temperature sensor 108 disposed nearby, such as a contact-type thermistor or a non-contact-type thermopile.

The pressure roller 105 presses against the heat roller 101 via the endless belt 104, thereby forming a heating nip with the both rollers. A surface stiffness of the pressure roller 105 is appropriately set so that a heating nip width of from 10 to 40 mm can be obtained.

The pressure roller 105 contacts the heat roller 101 with the endless belt 104 in between when the recording sheet S enters into the heating nip, and is separated from the heat roller 101 when the recording sheet S is not conveyed through the heating nip. Thus the pressure roller 105 is prevented from being excessively heated.

The cooling member 106 solidifies the heated toner so as to ensure smoothness by the endless belt 104 and prevents defective separation due to the viscosity of the toner when the recording sheet S is separated from the endless belt 104. With this purpose, the cooling member 106 is disposed at an interior surface of the endless belt 104 and opposite the recording sheet S, over a length along the taut portion of the endless belt 104 that is sufficient to ensure smoothness and prevent defective separation.

The cooling member 106 is comprised of a plurality of sections, L1, L2, and L3 in FIG. 1, from upstream to downstream in the conveyance direction of the recording sheet S. The most upstream section L1 in the conveyance direction of the recording sheet S is longest in the present embodiment. With this structure, cooling effects can be the highest in the section immediately after the heating. In the present embodiment, the length of each section from L1 to L3 is from 150 to 400 mm.

Each section of the cooling member 106 includes a coolant circulating device 110 in which a coolant is circulated. The coolant circulating device 110 includes a radiator 110A and a circulation pump 110B, and each coolant circulation device 110 is connected via a pipe with each section.

In the present embodiment, the coolant moving in the radiator 110A is cooled by a fan, not shown, and the air flow of the fan is configured to be switched from 0 to 11 $m^3$/min so that the cooling capacity can be changed. Further, the circulation pump 110B has a capacity of 0 to 15 liters/min, and the cooling efficiency of each section can be adjusted by changing the circulation amount of the coolant.

Next, a structure of the present embodiment will now be described.

A pair of separating members 109A and 109B (collectively referred to as separating member 109) are disposed at both ends of the cooling member 106 contacting the endless belt 104 so that the contact state of the endless belt 104 with the cooling member 106 is changed by the separating member 109. Hereinafter, the contacting and separating structure will now be described.

In FIG. 1, the plurality of sections of the cooling member 106 is disposed along the conveyance direction of the recording sheet S and along the taut portion of the endless belt 104. More specifically, the cooling member 106 is disposed between a position near the heating nip upstream in the conveyance direction of the recording sheet S and another position near and upstream of a separation roller 107 disposed downstream in the conveyance direction.

At both sides of the extending surface of the endless belt 104 opposite the cooling member 106 in the conveyance direction of the recording sheet S, separating rollers 109A and 109B each serving as a separating member are disposed at both sides of the cooling member 106. The separating roller 109A is disposed downstream of the heating nip formed between the heat roller 101 and the pressure roller 105, and the separating roller 109B is disposed upstream of the separation roller 107.

The separating rollers 109A and 109B separate the endless belt 104 from the cooling member 106 via a driving means, not shown. As described above, the section L1 of the cooling member 106 is closest to the heating nip where the largest thermal capacity is required and the section L3 is nearest to the separation roller 107 where a reduction of heat is necessary to ensure separability of the recording sheet S. The separating rollers 109A and 109B are set to have a separating stroke separating from the cooling member 106 when the separating rollers contacts the endless belt 104.

When the endless belt 104 is separated from the sections L1 and L3 of the cooling member 106, the section L2 remains to contact the cooling member 106 but the contacting state of the endless belt 104 with regard to the cooling member 106 in the section L2 is reduced compared to a case in which the recording sheet S is conveyed. With this structure, heat-retention and excess-heat prevention of the endless belt 104 are enabled.

The separating roller 109 is separated from the endless belt 104 when the recording sheet S enters into the heating nip, and contacts the endless belt 104 to separate the endless belt 104 from the cooling member 106 when the recording sheet does not enter the heating nip or at a time of start-up of an image forming operation.

In the present embodiment, excluding the case of waiting-time and the start-up time, the separating roller 109 contacts the endless belt 104 simultaneously with the contact between the pressure roller 105 and the heat roller 101 or at a time slightly later than the contact between the pressure roller 105 and the heat roller 101. With this structure, a sheet-sandwiching and conveyance force in the heating nip by the heat roller 101 and the pressure roller 105 is secured and a skew of the endless belt 104 can be prevented.

As configured above, the gloss applicator 100 is started when the glossiness of toner T of FIG. 1 carried on the recording sheet S needs to be improved.

At a time of start-up, the separating roller 109 contacts the endless belt 104 to cause the cooling member 106 to be separated from the taut portion of the endless belt 104.

Figure 2:
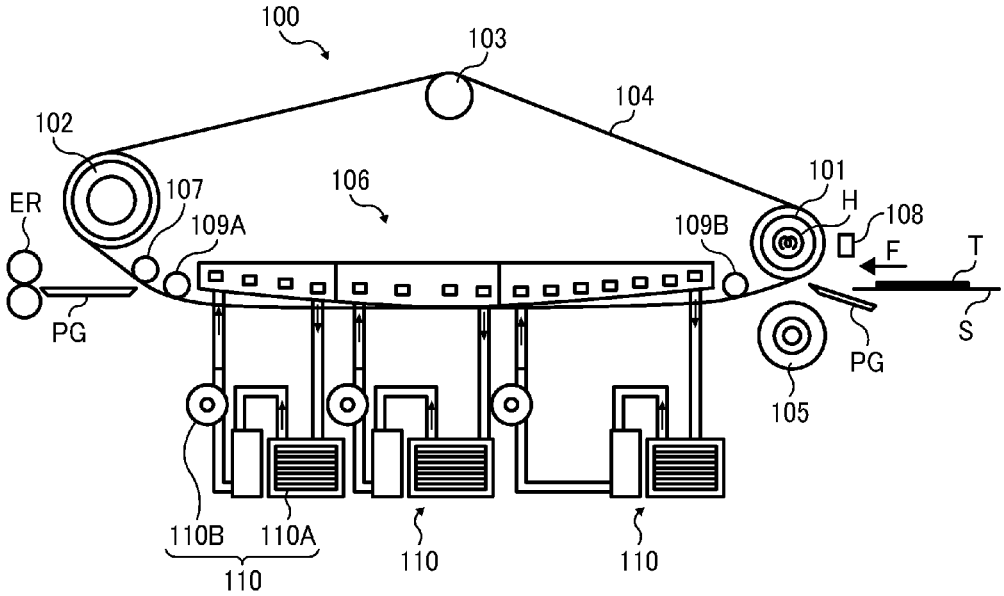
FIG. 2 is a schematic view of the gloss applicator of FIG. 1.

FIG. 2 shows a state in which the separating rollers 109A and 109B contact the endless belt at both ends of the cooling member 106 so as to move the taut portion of the endless belt 104 opposite the cooling member 106 away from the cooling member 106.

In this state, the temperature of the endless belt 104 is increased, the halogen heater H inside the heat roller 101 is turned on, the heat roller 101 is heated, and the temperature of the heat roller 101 is controlled by the temperature sensor 17.

Because almost the entire endless belt 104 opposite the cooling member 106 is separated from the cooling member 106, cooling effects of the cooling member 106 do not act on the endless belt 104, thereby shortening the rising time up to a predetermined heating temperature.

On the other hand, upon reaching a predetermined heating temperature, the separating roller 109 is separated from the endless belt 104 to cause the cooling member 106 to contact the taut portion of the endless belt 104.

At this time, the pressure roller 105 also contacts the heat roller 101, thereby forming a heating nip.

The pressure roller 105 contacts the heat roller 101 before the recording sheet S enters into the heating nip. More specifically, the pressure roller 105 contacts the heat roller 101 immediately before the recording sheet S enters into the heating nip. With this structure, the endless belt 104 is not caused slippage with respect to the heat roller 101 at the heating nip.

When the recording sheet S enters into the heating nip, the toner carried on the recording sheet S is heated by the heat to less than the glass transition point and softened, and is conveyed together with the movement of the endless belt 104 while contacting a surface of the endless belt 104 at a nip pressure defined at the heating nip.

The toner softened during the conveyance process is given a smoothness which can improve the glossiness according to a surface smoothness of the endless belt 104.

The toner T on the recording sheet S, which has passed through the heating nip, moves along the taut portion of the endless belt 104 opposite the cooling member 106 and is cooled and solidified.

As a structure to change a contact state of the endless belt with respect to the cooling member 106, JP-2011-85873-A discloses a structure to change a length contacting the cooling member of the taut portion of the endless belt 104.

In the subject structure, the contact length of the cooling member with the endless belt is changed by moving the separation roller or a separation claw along the taut portion of the endless belt.

However, this structure only enables to change the thermal capacity applied to the toner so that the desired glossiness can be obtained and does not exert any effect to prevent the heat-raising time from prolonging or the degradation of the endurance of the endless belt due to an occurrence of the slippage.

In the present embodiment, the length of the endless belt opposed to the cooling member is constant and the constant length of the endless belt is contacted and separated, thereby shortening the temperature-raising time and preventing the damage of the belt due to heat and abrasion.

Because the disclosed structure employs the cooling member configured to be cooled by air without provision of the pipework, even though the disclosed system is applied to the present invention, the circulation system of the coolant needs to be adjusted with the length of the taut portion of the endless belt and the structure becomes complicated.

Further, when the stretched length of the endless belt is changed, because the conveyance surface of the recording sheet S fluctuates, it becomes difficult to provide a uniform conveyance surface and an inadvertent problem such as a defective sheet conveyance may occur.

Unlike the disclosed structure, in the present embodiment the length of the taut portion of the endless belt is kept constant. Therefore, there is no need to change the length and an initial purpose can be achieved with an uncomplicated structure.

Next, a modified example of the structure used in the present embodiment will now be described.

Figure 3:
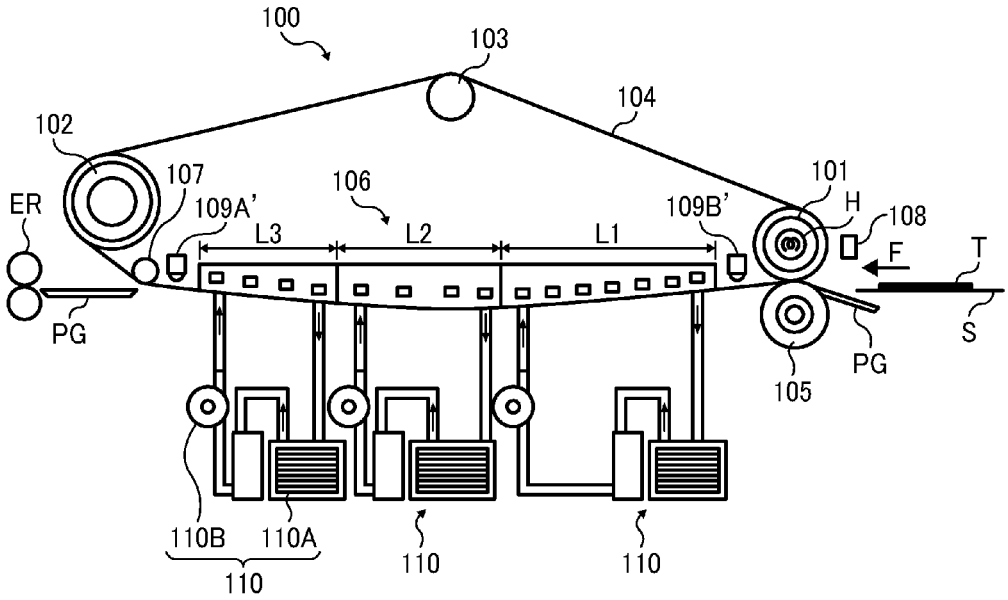
FIG. 3 is a schematic view of the gloss applicator of FIG. 1 specifically illustrating a modified example thereof.

FIG. 3 shows another embodiment in which a rolling member such as a spherical body is used as a separating member as illustrated in FIG. 1.

As illustrated in FIG. 3, separating members 109A' and 109B' each include a support member and a spherical body loaded in the support member and are disposed at both ends where the cooling member 106 is disposed along the endless belt 104 similarly to the case of FIG. 1.

The separating members 109A' and 109B' have a similar function as illustrated in FIG. 1 and can be contacted to and separated from the endless belt 104 against the cooling member 106.

Figure 4:
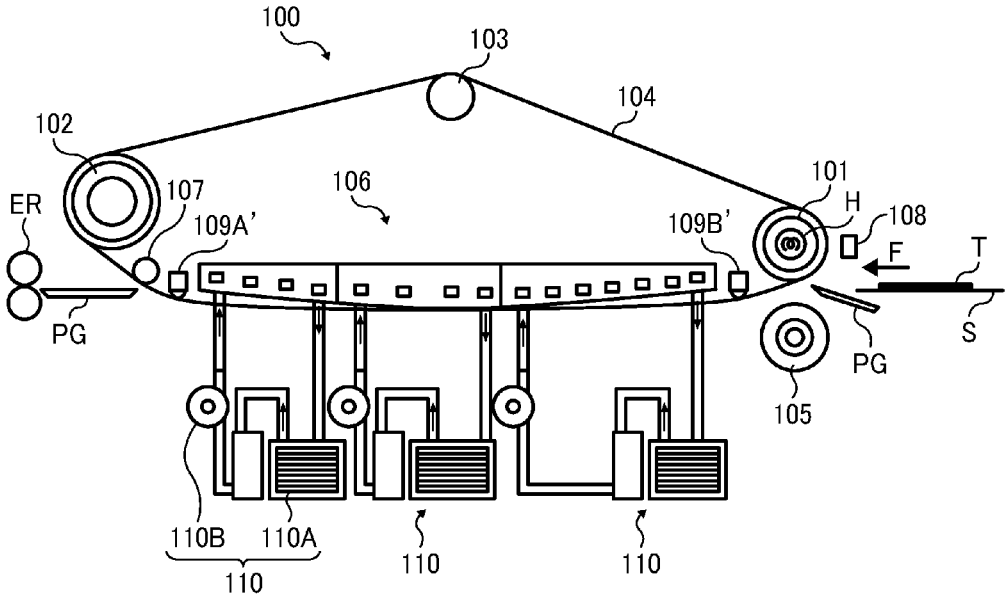
FIG. 4 is a schematic view of the gloss applicator of FIG. 3.

FIG. 4 shows a state in which the endless belt 104 is separated from the cooling member 106 by the separating members 109A' and 109B'. The effect of the separating members 109A' and 109B' in this case is the same as that in FIGS. 1 and 2.

With such a structure, because the time required for raising the temperature of the endless belt can be shortened during the cooling member's non-contacting time, the consumed power can be reduced. In addition, because the cooling member is prevented from becoming a resistant member for the movement of the endless belt and an occurrence of the slippage is prevented, the abrasion of the endless belt can be prevented, thereby improving the durability of the belt.

The gloss applicator 100 as illustrated in FIGS. 1 through 4 can be contacted to the image forming apparatus including a fixing device for the recording sheet S on which an image has been transferred.

Figure 5:
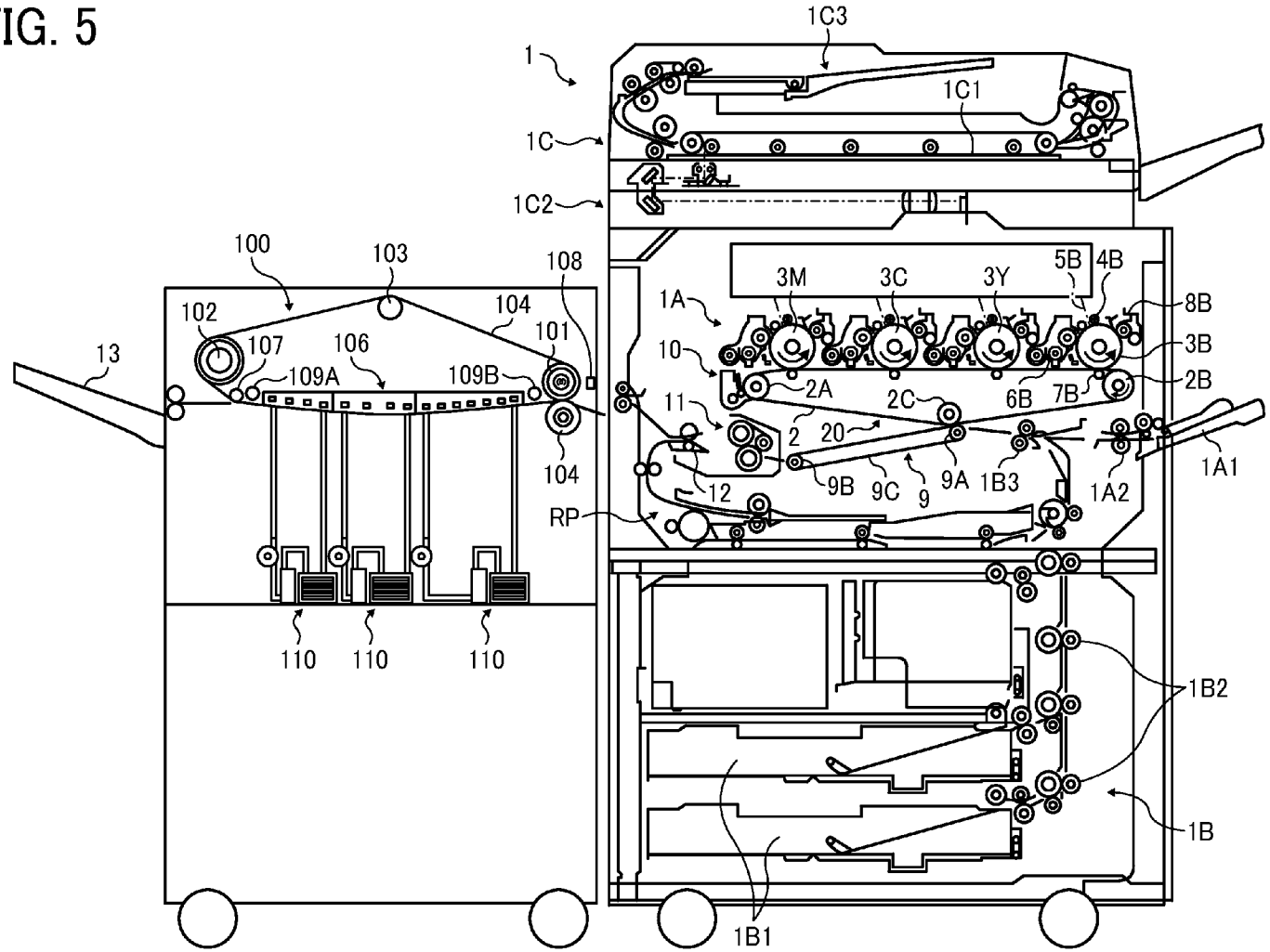
FIG. 5 is a schematic view of an image forming apparatus using the gloss applicator of FIG. 1 or 2.

FIG. 5 is a view illustrating a structure of an image forming apparatus according to an embodiment of the present invention.

The image forming apparatus 1 as illustrated in FIG. 1 is a color printer and includes a tandem-type structure in which a plurality of photoreceptors each as a latent image carrier is disposed in parallel. Each photoreceptor can form an image of a color corresponding to a color-separated color. A toner image formed on each photoreceptor is once transferred in a superimposed manner onto an intermediate transfer belt and the superimposed image is transferred en bloc onto a sheet such as a recording sheet, thereby forming a full-color image.

In the present embodiment, the image forming apparatus is not limited to a color printer, but also includes a color copier, a facsimile apparatus, and a professional-use printer.

As illustrated in FIG. 5, a color printer as one of image forming apparatuses or an image forming apparatus 1 includes an image forming unit 1A disposed at a center in the vertical direction of the apparatus, a sheet feed unit 1B underneath the image forming unit 1A, and an image scanning unit 1C including an original platen 1C1.

A transfer device 20 including an intermediate transfer belt 2 with a taut portion in the horizontal direction is disposed in the image forming unit 1A and a structure to form an image of a color having a complementary color relation with a color-separated color is provided at an upper portion of the intermediate transfer belt 2.

In the image forming unit 1A, photoreceptors 3B, 3Y, 3C, and 3M capable of bearing an image by a color of toner (yellow, magenta, cyan, or black) having a relation of complementary color are disposed along the taut portion of the intermediate transfer belt 2. Hereinafter, if the explanation is inclusively applied to the photoreceptor, the photoreceptor is referred to as the reference numeral of 3.

Each photoreceptor 3B, 3Y, 3C, or 3M is formed of a drum rotatable in the same direction (i.e., in the counterclockwise direction in FIG. 5). Around each photoreceptor, a charger 4, a writing unit 5, a developing device 6, a primary transfer device 7 as one of transfer bias applying means, and a cleaning device 8. (As a representative example to be explained in detail, parts around the photoreceptor 3B are applied with respective reference numerals having a suffix B.)

The transfer device 20 including the intermediate transfer belt 2 corresponds to a primary transfer section in which a visual image from the image forming unit including respective photoreceptors is sequentially transferred, and the intermediate transfer belt 2 is stretched around a plurality of rollers 2A to 2C so as to rotate in the same direction with the photoreceptor at a position opposite the photoreceptor.

The rollers 2A and 2B together form a taut portion of the intermediate transfer belt 2 and the roller 2C is disposed opposed to a secondary transfer unit 9 with the intermediate transfer belt 2 in between. In the present embodiment, the roller 2A is a driven roller and the roller 2B is a driving roller. Further, as illustrated in FIG. 5, reference numeral 10 denotes a cleaning unit for the intermediate transfer belt.

The secondary transfer unit 9 includes a transfer belt 9C stretched around a charged drive roller 9A and a driven roller 9B and movable in the same direction as the moving direction of the intermediate transfer belt 2.

In the secondary transfer unit 9, because the transfer belt 9C has been charged by the charging drive roller 9A, the recording sheet S is electrostatically absorbed to the transfer belt 9C and is conveyed. During such a conveyance process, a multi-color image superimposedly formed on the intermediate transfer belt or a monochromatic image carried thereon is transferred en bloc onto the recording sheet S.

The sheet feed unit 1B to send a recording sheet S to the secondary transfer position includes a plurality of sheet feed cassettes 1B1, a plurality of conveyance rollers 1B2 disposed in the conveyance path of the recording sheet S fed from the plurality of sheet feed cassettes 1B1, and a registration roller pair 1B3 positioned before the secondary transfer position.

In the present embodiment, the sheet feed unit 1B includes a conveyance path of the recording sheet S fed out from the sheet feed cassettes 1B1 and another structure to convey the recording sheet S not contained in the sheet feed cassettes 1B1 toward the secondary transfer position, the structure of which includes a manual tray 1A1 disposed by extending a part of the side wall of the image forming unit 1A and a let-out roller 1A2.

On the way of the conveyance path of the recording sheet S from the sheet feed cassettes 1B1 to the registration roller pair 1B3, there is a meeting point of the recording sheet S from the sheet feed cassettes 1B1 and from the manual tray 1A1. The registration roller pair 1B3 can set an appropriate timing for either the recording sheet S fed from the conveyance paths or from the sheet feed cassettes 1B1.

In the writing unit 5 (reference numeral 5B only is shown), an original placed on the original platen 1C1 included in the image scanning unit 1C is scanned and image information is obtained, and writing optical beams from the image scanning unit 1C is controlled by the scanned image or image information output from a computer, not shown, and an electrostatic latent image corresponding to the image information is formed on the photoreceptors 3B, 3Y, 3C, and 3M.

The image scanning unit 1C includes a scanner 1C2 to expose and scan the original placed on the original platen 1C1 and further an ADF 1C3 is disposed above the original platen 1C1. The ADF 1C3 includes a structure to turn the original sent to the original platen 1C1 in reverse and both sides of the original can be scanned.

The latent image formed on the photoreceptors 3B, 3Y, 3C, and 3M by the writing unit 5 is rendered visible by the developing device 6 (reference numeral 6B only is shown), and is primarily transferred to the intermediate transfer belt 2. Each color toner image transferred sequentially in a superimposed manner to the intermediate transfer belt 2 is secondarily transferred to the recording sheet S by the secondary transfer device 9 en bloc.

The thus-secondarily transferred image on the recording sheet S is an unfixed image and the unfixed image carried on the recording sheet S is fixed by the fixing device 11. The fixing device 11 includes a belt fixing structure including a fixing belt to be heated by a heat roller, not shown, and a pressure roller disposed opposite the fixing belt. By providing a contact area, that is, a nip area is formed between the fixing belt and the pressure roller, a heating area to the recording sheet S can be extended more compared to other fixing structures.

The recording sheet S having passed through the fixing device 11 reaches a switching claw 12 disposed downstream of the fixing device 11, in which the conveyance direction of the recording sheet S is selectably switched by the switching claw 12 and is conveyed to either a conveyance path toward the gloss applicator 100 contacted to the image forming apparatus 1 or a reverse conveyance path RP.

When the gloss of the toner carried on the recording sheet S which has passed through the fixing device 11 needs to be improved and the recording sheet S is simply discharged without being subjected to a gloss improving process, the recording sheet S is introduced into the gloss applicator 100.

The recording sheet S introduced into the gloss applicator 100 is applied with a higher gloss by being subjected to the structure as illustrated in FIGS. 1 through 4 and is separated from the endless belt 104 by the separation roller 107 disposed downstream in the sheet conveyance direction.

When the gloss application process is not required, the recording sheet S enters into the heating nip while the gloss applicator 100 is being kept in the waiting state. Therefore, the recording sheet S introduced from the fixing device 11 does not contact the endless belt 104 and is conveyed toward the sheet discharge tray 13.

In the present embodiment, whether or not the recording sheet S requires a process to improve glossiness of the toner carried on the recording sheet S discharged from the image forming apparatus 1 can be set manually by an operator.

In such an event, a control panel through which selection of the image forming mode or a number of prints can be set for the image forming apparatus 1 includes a selector to select the glossiness. In accordance with the setting input through the control panel, the gloss applicator 100 in the stand-by mode is caused to switch contacting or separating operation of the separating members 109A and 109B or 109A' and 109B'.

By disposing the gloss applicator at a position from which the recording sheet S is discharged from the fixing device 11 in the image forming apparatus 1, heat remaining on the recording sheet S discharged from the fixing device 11 can be used for improving the glossiness, resulting in reducing the power consumption required for raising a temperature at the gloss applicator 100.

Additional modifications and variations of the present invention are possible in light of the above teachings. It is therefore to be understood that, within the scope of the appended claims, the invention may be practiced other than as specifically described herein.

What is claimed is:

1. A gloss applicator configured to apply a gloss to toner by heating a toner image on a recording medium and forcibly cooling the toner, the gloss applicator comprising:

a plurality of rollers including a heat roller, the heat roller having a built-in heat source disposed upstream in a conveyance direction of the recording medium bearing the toner image thereon;

an endless belt wound around the plurality of rollers and forming a taut portion along the conveyance direction of the recording medium;

a pressure roller disposed at a position opposite the heat roller with the endless belt disposed between the pressure roller and the heat roller, the pressure roller being contacted to or separated from the endless belt;

a cooling member disposed at an interior surface of the taut portion of the endless belt contacting the recording medium; and a pair of separating members disposed at both ends of the cooling member in the conveyance direction of the recording medium and configured to alternately contact and at least partially separate the taut portion of the endless belt to and from the cooling member so as to change an area of contact of the cooling member with the endless belt, wherein the pair of separating members includes a roller, the roller contactable to and separable from the endless belt.

2. A gloss applicator as claimed in claim 1, wherein the pair of separating members is disposed at an interior side of the endless belt and a pressing force of the separating members toward the endless belt is changed so that the endless belt is contacted to or separated from the cooling member.

3. The gloss applicator as claimed in claim 1, wherein the pair of separating members is separated from the endless belt in a state in which the endless belt is in contact with the cooling member.

4. The gloss applicator as claimed in claim 1, wherein the pair of separating members is separated from the endless belt when the endless belt comes into contact with the cooling member upon the recording medium being conveyed between the heat roller and the pressure roller.

5. The gloss applicator as claimed in claim 1, wherein:

the endless belt contacts the cooling member immediately before the recording medium is conveyed between the heat roller and the pressure roller; and the heat roller and the pressure roller are kept in contact with each other when the cooling member contacts the endless belt along the taut portion of the endless belt.

6. The gloss applicator as claimed in claim 1, wherein upon reaching a predetermined heating temperature, the pair of separating members is separated from the endless belt to cause the taut portion of the endless belt to contact the cooling member and the pressure roller contacts the heat roller.

7. The gloss applicator as claimed in claim 1, wherein the cooling member comprises a plurality of adjacent sections aligned serially along the conveyance direction of the recording medium, each section comprising a coolant circulating device in which a coolant is circulated, each coolant circulating device comprising a radiator and a circulation pump.

8. An image forming apparatus comprising:

a fixing device to fix a toner image on a recording medium; and the gloss applicator as claimed in claim 1, disposed downstream in the conveyance direction of the recording medium upon discharge of the recording medium from the fixing device.

9. A gloss applicator configured to apply a gloss to toner by heating a toner image on a recording medium and forcibly cooling the toner, the gloss applicator comprising:

a plurality of rollers including a heat roller, the heat roller having a built-in heat source disposed upstream in a conveyance direction of the recording medium bearing the toner image thereon;

an endless belt wound around the plurality of rollers and forming a taut portion along the conveyance direction of the recording medium;

a pressure roller disposed at a position opposite the heat roller with the endless belt disposed between the pressure roller and the heat roller, the pressure roller being contacted to or separated from the endless belt;

a cooling member disposed at an interior surface of the taut portion of the endless belt contacting the recording medium; and a pair of separating members disposed at both ends of the cooling member in the conveyance direction of the recording medium and configured to alternately contact and at least partially separate the taut portion of the endless belt to and from the cooling member so as to change an area of contact of the cooling member with the endless belt, wherein the pair of separating members is separated from the endless belt in a state in which the endless belt is in contact with the cooling member.

10. A gloss applicator configured to apply a gloss to toner by heating a toner image on a recording medium and forcibly cooling the toner, the gloss applicator comprising:

a plurality of rollers including a heat roller, the heat roller having a built-in heat source disposed upstream in a conveyance direction of the recording medium bearing the toner image thereon;

an endless belt wound around the plurality of rollers and forming a taut portion along the conveyance direction of the recording medium;

a pressure roller disposed at a position opposite the heat roller with the endless belt disposed between the pressure roller and the heat roller, the pressure roller being contacted to or separated from the endless belt;

a cooling member disposed at an interior surface of the taut portion of the endless belt contacting the recording medium; and a pair of separating members disposed at both ends of the cooling member in the conveyance direction of the recording medium and configured to alternately contact and at least partially separate the taut portion of the endless belt to and from the cooling member so as to change an area of contact of the cooling member with the endless belt, wherein the pair of separating members is separated from the endless belt when the endless belt comes into contact with the cooling member upon the recording medium being conveyed between the heat roller and the pressure roller.

* * * * *